United States Patent [19]

Fujiwara

[11] 4,205,663

[45] Jun. 3, 1980

[54] DEVICE FOR MASSAGING THE SOLE OF FOOT

[76] Inventor: Tsuyoshi Fujiwara, 3-23-16 Chuo, Ota-ku, Tokyo, Japan

[21] Appl. No.: 921,199

[22] Filed: Jul. 3, 1978

[30] Foreign Application Priority Data

Jul. 15, 1977 [JP] Japan ..... 52-93455[U]

[51] Int. Cl.[2] ..... A61H 15/00

[52] U.S. Cl. ..... 128/57; 128/25 B

[58] Field of Search ..... 128/57, 25 B, 67, 24.3

[56] References Cited

U.S. PATENT DOCUMENTS

| | | | |
|---|---|---|---|
| 448,883 | 3/1891 | Kahn | 128/57 |
| 1,345,096 | 6/1920 | Mount | 128/57 |
| 2,306,424 | 12/1942 | Betz | 128/57 |
| 2,895,470 | 7/1959 | Reiter | 128/25 B |
| 3,359,572 | 12/1967 | Blackwell | 128/25 B |
| 3,415,514 | 12/1968 | Weiks | 128/25 B |
| 3,664,334 | 5/1972 | O'Neil | 128/57 |

FOREIGN PATENT DOCUMENTS 13207 of 1899 United Kingdom ..... 128/25 B

*Primary Examiner*—Lawrence W. Trapp

*Attorney, Agent, or Firm*—Pearne, Gordon, Sessions, McCoy & Granger

[57] ABSTRACT

A device for massaging the sole of foot comprises a plurality of rows of projection rollers having projections extending in substantially radial directions of the respective rollers. The positions of the rollers and the lengths of the projections are so determined that a surface connecting the uppermost points of the projections is raised at the central portion thereof. Such arrangement of the rollers renders the projections as a whole into conformity with the soles of feet, particularly to the arches of feet. One may place both feet on the device and move the feet back and forth in a direction perpendicular to the rows to conduct press massaging on the soles of feet.

7 Claims, 18 Drawing Figures

DEVICE FOR MASSAGING THE SOLE OF FOOT

BACKGROUND OF THE INVENTION

The present invention relates to a device for massaging the sole of foot including the arch of foot.

A conventional massage device for such a purpose is provided with projection rollers. The rollers are rotatable about axes parallel to each other and positioned in one and the same flat plane, and the projections are of the same length, so that the general configuration of the projections as a whole is not in conformity with the configuration of the sole of foot, particularly the arch of foot.

SUMMARY OF THE INVENTION

An object of the present invention is to provide a massage device having projection rollers formed and arranged in conformity with the configuration of the sole of foot.

A massage device according to the present invention comprises a frame, and a plurality of rows of projection rollers. Each roller has projections extending in substantially radial directions of the respective roller. The rows are substantially parallel with each other. The positions of the rollers and the lengths of the projections are so determined that a smooth surface connecting the uppermost points of the projections is raised at the central portion of the surface.

The projection rollers may be provided to be rotatable about axes substantially parallel to each other.

The projections may be formed of resilient material, such as a resilient plastic material, so that the projections are resiliently bent when pressed against the sole of foot. To enhance the resilient property, the projections may be made hollow.

The projections of each of the rollers may be arranged to form at least one array, each consisting of projections circumferentially aligned and spaced equally from each other.

Where each roller has a plurality of arrays, the projections of adjacent arrays may be staggered in respect to each other.

Each row of projection rollers may be provided at least one shaft mounted to said frame, and the projection rollers of each row may be rotatably mounted on the shaft.

The frame may comprise a pair of side walls parallel with each other. The frame may further comprise a front wall and a rear wall respectively connecting the front ends and the rear ends of the side walls. The frame may further comprise a bottom plate having the edges fixed to the bottom edges of the side walls and the front and rear walls.

Each row of projection rollers may be provided with a single shaft extending from one of the side walls to the other side wall and mounted to the side walls, and the projection rollers of each row may be rotatably mounted on the shaft. The distance between the top end of the projection and the axis of the roller may be relatively long at the middle of the row and is decreased toward both ends of the row, so that a curve connecting the uppermost points of the projections of the rollers of each row is upwardly bent.

The distance between the top end of the projection and the axis of the roller may be long at the middle of the side walls and may be decreased toward both ends of the side walls, so that a curve connecting the uppermost points of the projections aligned in a direction perpendicular to the rows is upwardly bent. Alternatively, or in addition, the height at which the shafts is positioned is elevated at the middle of the side walls and is decreased toward both ends of the side walls.

The shafts on which the rollers are mounted may be upwardly bent. The curvature of the shafts may be relatively great at the middle of the side walls and may be decreased toward both ends of the side walls.

The frame may further comprises at least a pair of intermediate walls substantially parallel with each other and each of the rows is provided with a plurality of shafts extending throughout the respective space between the adjacent ones of the walls to be mounted to the walls. The height of the shafts of each row is elevated at the middle of each row and is decreased toward both ends of each row. In addition, the height of the shafts is elevated at the middle of the side walls and is decreased toward both ends of the side walls.

The massage device according to the invention can be used to conduct effective press massaging on the sole of foot. By such massaging, circulation of blood is encouraged, and metabolism is promoted.

BRIEF DESCRIPTION OF THE DRAWINGS

Other features and advantages of the present invention will be apparent from the following description of the preferred embodiments taken in conjunction with the accompanying drawings, in which.

DETAILED DESCRIPTION OF THE PREFERRED EMBODIMENTS

Figure 1A:
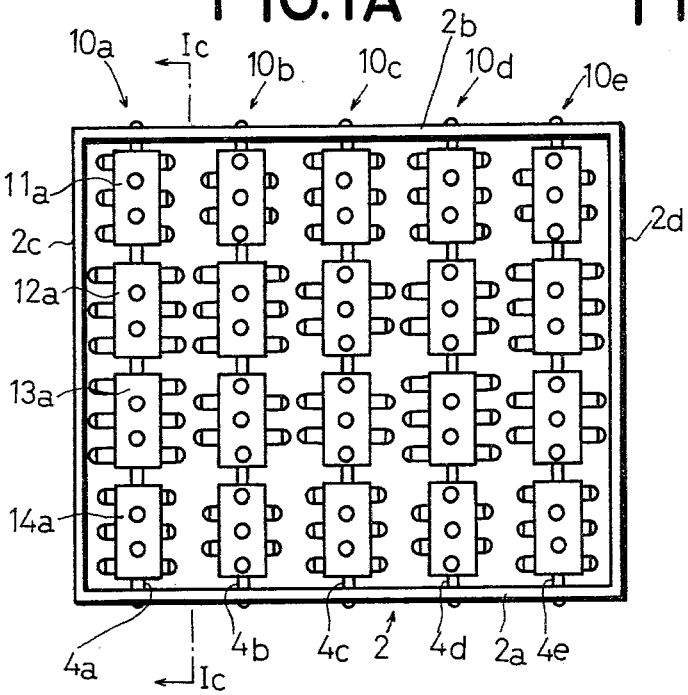
FIGS. 1A, 1B and 1C respectively show a top view, a fragmentary broken elevational view and a sectional view of an embodiment of a massage device according to the present invention.
Figure 1C:
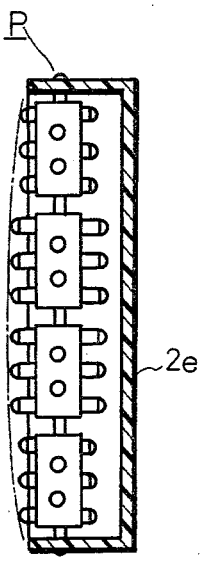
Figure 1B:
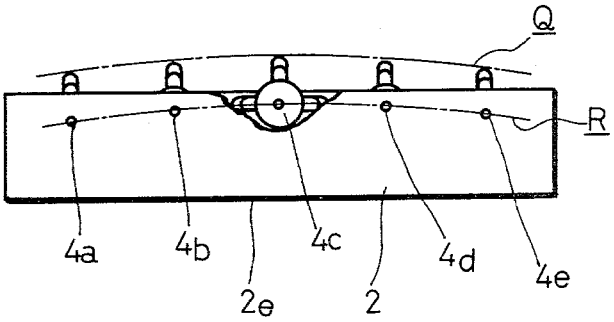

Referring now more particularly to FIGS. 1A, 1B and 1C, there is shown an embodiment of a massage device according to the present invention. The massage device of this embodiment comprises a rectangular frame 2 comprising a pair of side walls *2a*, *2b*, a front end wall 2c connecting the front ends of the side walls 2a, 2b, a rear end wall 2d connecting the rear ends of the side walls 2a, 2b, and a bottom plate 2e having the edges connected to the bottom edges of the walls 2a through 2d. The overall configuration of the frame 2 of this embodiment is of a shallow box. The frame 2 may be formed of a plastic material integrally by molding.

In the embodiment illustrated, there are provided five shafts 4a through 4e, extending parallel with each other from one side wall to the other. As shown in FIG. 1B, the shaft 4c at the innermost location is positioned at the most elevated height, the adjacent shafts 4b, 4d are at the intermediate height, and the shafts 4a, 4b at the extreme ends are of the lowest height, so that a smooth curve R connecting the centers of the shafts, as viewed from the side of the device, is substantially arcuate and is relatively high at the middle and is lowered toward both ends: in other words, the curve is upwardly bent.

Figure 2A:
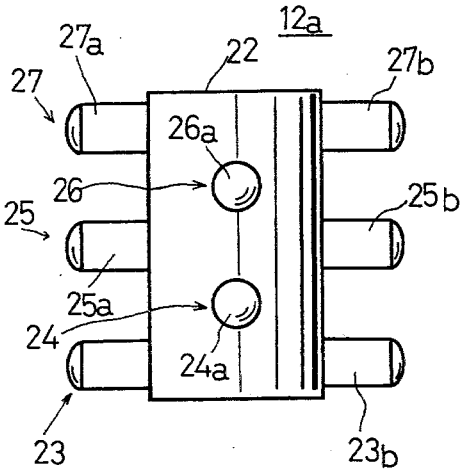
FIGS. 2A and 2B respectively show a top view and a side view of a type of projection roller incorporated in the massage devices of FIGS. 1A through 1C.
Figure 2B:
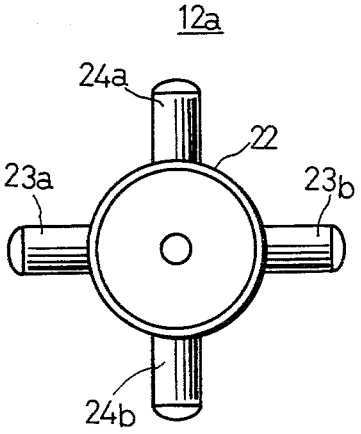

Rotatably mounted on each of the shaft 4a through 4e are rows 10a through 10e of projection rollers. In the embodiment illustrated, all the rows are alike, so that description of one will suffice. The row 10a for instance comprises four projection rollers 11a, 12a, 13a and 14a. The projection rollers 12a, 13a are alike, and the projection roller 12a for instance is, as shown in FIGS. 2A and 2B, composed of a cylindrical body portion 22 and a plurality of arrays 23 through 27 of projections fixed to the body portion to extend substantially in radial directions. In the illustrated embodiment, the array 23 comprises two projections 23a and 23b spaced 180° apart. Similarly, each of the other arrays comprises two projections. Projections of adjacent arrays, 23 and 24 for instance, are staggered in respect to each other. The projections may be formed of rubber or a resilient plastic material. To enhance the resilient property of the projections, the projections may be made hollow. The projections may be formed integrally with the body portion by molding.

Figure 3A:
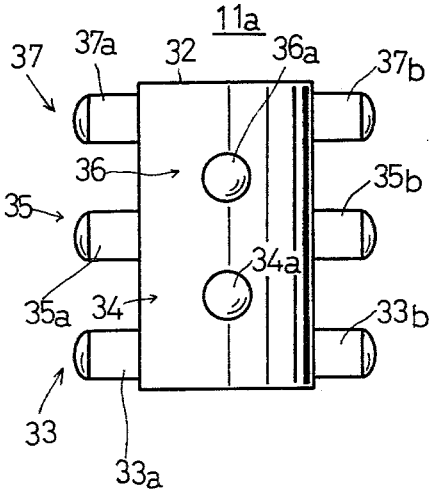
FIGS. 3A and 3B respectively show a top view and a side view of a projection roller similar to that of FIGS. 2A and 2B, but having shorter projections.
Figure 3B:
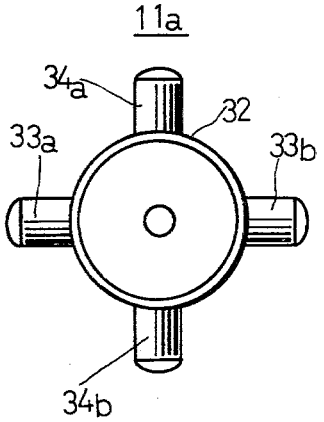

The projection roller 11a, 14a are alike, and the projection roller 11a for instance is, as shown in FIGS. 3A and 3B, similar in construction to the projection roller 12a of FIGS. 2A and 2B, except that the distance between the top ends of the projections and the axis of the roller is shorter in the roller 11a than in the roller 12a.

Instead of, or in addition to the rotatable mount of the rollers on the shafts, the shafts may be rotatably mounted to the frame 2. As the rollers rotates, the top end of each projection generates a circular locus, and the uppermost point of the locus is referred to as the uppermost point of projection.

Because the distance between the top end of the projection and the axis of the roller is shorter in the rollers at both ends of the row than in the rollers at the middle of the row, a curve connecting the uppermost points of the projections of the rollers of the row is upwardly bent, as indicated by a chain line P in FIG. 1C.

Because the curve connecting the centers of the shafts is upwardly bent as indicated by a chain line R, a curve connecting the uppermost points of the projections aligned in a direction perpendicular to the rows is also upwardly bent as indicated by a chain line Q.

It will be appreciated that the resultant smooth surface connecting the uppermost points of the projections is raised at the central portion thereof.

The width and the length of the massage device can be so determined that one may place both feet on the set of projections.

To use this massage device, one may place one's feet onto the projection rollers and move the feet back and forth in a direction perpendicular to the shafts. By doing so, press massaging is effected on the soles of feet. The force of pressing against the rollers and the velocity of movement can be adjusted as desired.

Since the surface connecting the uppermost points of the projections, the projection rollers as a whole is in conformity with the configuration of the soles of the feet, particularly the arches of feet.

In the illustrated embodiment, each roller is so formed that the projections of adjacent rows are staggered in respect to each other, so that massaging is effected evenly throughout the soles of feet.

Since the projections are resilient, they can be resiliently bent when pressed against the soles of feet. As the sole of foot is brought into contact with each projection, the projection is at oblique angle relative to the sole, and is resiliently bent to exert a moderate pressure. As the foot is moved further, the roller rotates and the projection is at right angles with the contacting surface of the sole, and impart a greatest pressure to the sole. As the foot is moved still further, the roller rotates and the projection is at an oblique angle with the contacting surface of the sole, and the pressure is gradually reduced until the sole is finally separated from the projection. Thus, there are three steps of different forms of massaging while each projection is in contact with the sole.

Stiffness of the sole of foot differs from one part to another, and accordingly, as the foot is moved over the rollers, the projections are bent resiliently and their top ends are shifted in various directions, i.e., in forward and backward directions, in lateral directions, and upward and downward directions. It is also possible that the top ends of the projections are in contact with different points of the sole during forward movement and during backward movement.

One may move the feet alternately or one may move both feet simultaneously.

Figure 4A:
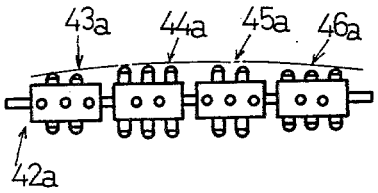
FIGS. 4A through 4C respectively show elevational views of rows of rollers mounted on shafts, according to another embodiment of the invention.
Figure 4B:
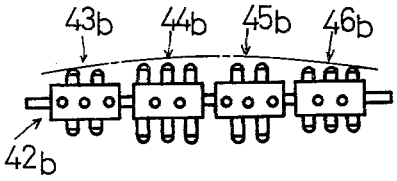
Figure 4C:
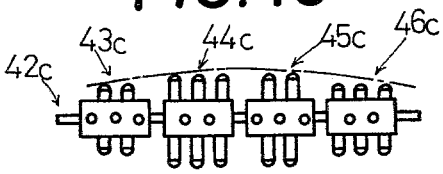
Figure 4D:
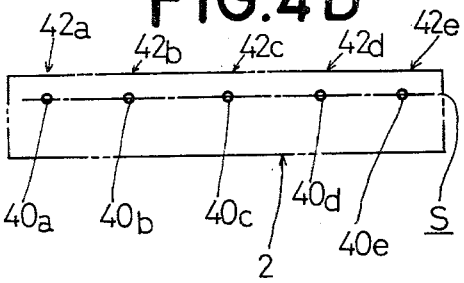
FIG. 4D shows an arrangement of the shafts, according to the embodiment of FIGS. 4A through 4C.

FIGS. 4A through 4D show a modification of arrangement and construction of the rollers. As will be seen in FIG. 4D, the shafts 40a through 40e are positioned at the same height relative to the frame 2, as indicated by a chain line S. A first row 42a of projection rollers mounted on the shaft 40a are, as shown in FIG. 4A, composed of four projection rollers 43a, 44a, 45a and 46a. The distance between the top end of the projection and the axis of the roller is greater in the rollers 44a, 45a at the middle, than in the rollers 43a, 46a at the ends. A second row 42b of projection rollers mounted on the shaft 40b are, as shown in FIG. 4B, composed of four projection rollers 43b, 44b, 45b and 46b. The distance between the top end of the projection roller and the axis of the roller is greater in the projection rollers 44b, 45b than in the rollers 43b, 46b. Moreover, such a distance is greater in the rollers 44b, 45b than in the rollers 44a, 45a, and is also greater in the rollers 43b, 46b than in the rollers 43a, 46a. A third row 42c of projection rollers mounted on the shaft 40c are, as shown in FIG. 4C, composed of four projection rollers 43c, 44c, 45c and 46c. The distance between the top end of the projection and the axis of the roller is greater in the rollers 44c, 45c than in the rollers 43c, 46c. Moreover, such a distance is greater in the rollers 44c, 45c than in the rollers 44b, 45b, and is also greater in the rollers 43c, 46c than in the rollers 43b, 46b.

A fourth row 42d of rollers is similar to the second row 42b. A fifth row 42e is similar to the first row 42a.

Thus, it will be apparent from the foregoing, a curve connecting the uppermost points of the projections of the rollers mounted on the same shaft is upwardly bent. Also, a curve connecting the uppermost points of the projections aligned in a direction perpendicular to the rows is also upwardly bent. Consequently, the projection rollers are in conformity with the configuration of the soles of feet.

According to the embodiment of FIGS. 4A through 4D the shafts 40a through 40e can be mounted at the same height, so that in this regard manufacture of the device is facilitated.

Figure 5A:
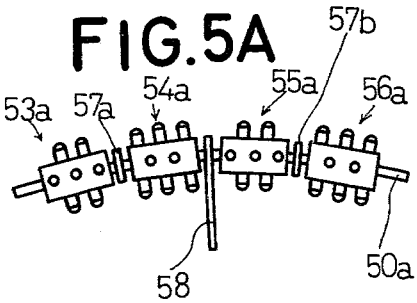
FIG. 5A shows an elevational view of a row of rollers mounted on an upwardly bent shaft according to another embodiment of the invention.
Figure 5B:
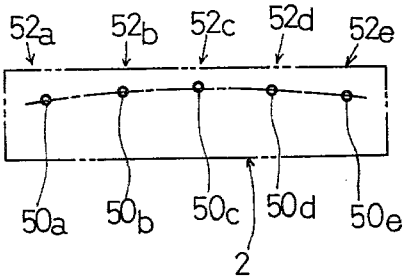
FIG. 5B shows an arrangement of shafts according to the embodiment of FIG. 5A.

FIGS. 5A and 5B show still another modification of arrangement of the rows of projection rollers and the shafts on which the rollers are mounted. A curve connecting the points at which the shafts 50a through 50e are fixed to the side walls of the frame is, as schematically illustrated in FIG. 5B, elevated at the middle of the side walls and is lowered toward both ends of the side walls. The shafts are all upwardly bent, the curvatures being substantially identical, and the shaft 50a is shown in FIG. 5A as an example. The projection rollers 53a through 56a are alike, and the distance between the top end of the projection and the axis of the roller is identical. Provided between the rollers 53a and 54a, and between the rollers 55a and 56a, are washers 57a, 57b for preventing interference between the adjacent rollers. An auxiliary support member 58 is provided to support at one end thereof the shaft between the rollers 54a and 55a and is fixed at the other end thereof to the frame 2. The support member 58 may be separately provided for each of the shafts 52a through 52e, or alternatively there may be a common support member extending from the front wall to the rear wall to support all the shafts.

Figure 6A:
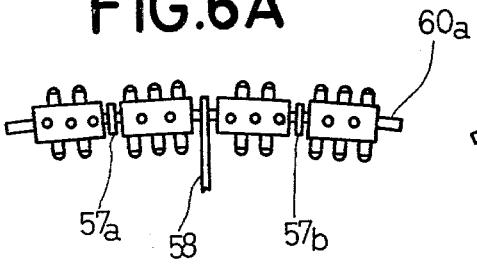
FIGS. 6A through 6C respectively show elevational views of rows of rollers mounted on bent shafts of different curvature according to still another embodiment of the invention.
Figure 6C:
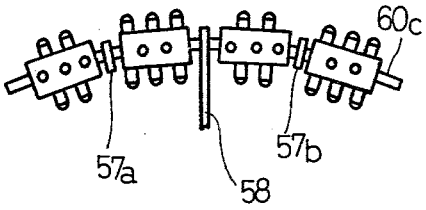
Figure 6B:
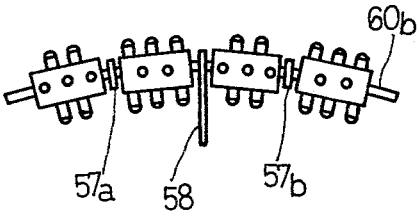
Figure 6D:
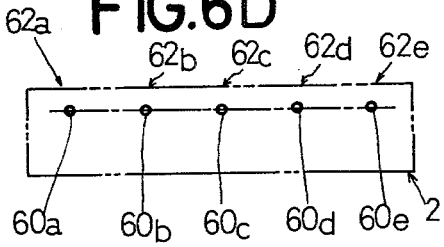
FIG. 6D shows an arrangement of the shafts according to the embodiment of FIGS. 6A and 6C.

FIGS. 6A through 6D show still another modification of arrangement of the rollers. The shafts 60a through 60e are, as schematically illustrated in FIG. 6D, fixed to the frame at the same height. The shafts are all upwardly bent, in the same manner as in FIG. 5A. However, the curvatures of the shafts are different. The curvature of the shaft 60c, the shaft at the middle of the side walls, is the greatest. The curvature of the shaft 60b, 60d are identical to each other and smaller than that of the shaft 60c. The curvatures of the shafts 60a, 60e are identical to each other and smaller than those of the shaft 60b, 60d. The projection rollers mounted on the shafts are all alike, and there are provided washers and support members in the same manner as in FIG. 5A.

Figure 7:
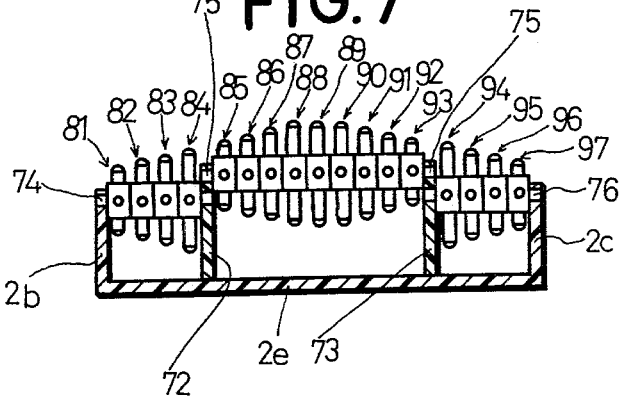
FIG. 7 shows an elevational view, partially in section, of a row of rollers mounted on a plurality of shafts at different heights, according to still another embodiment of the invention.

FIG. 7 shows still another modification of arrangement of the row of projection rollers. As illustrated, there are provided a pair of intermediate walls 72, 73 extending parallel with the side walls 2b, 2c and from the front wall to the rear wall, and fixed to the front and rear walls as well as to the bottom plate 2e. One row is provided with three shafts 74, 75, 76. The shaft 74 extends throughout the space between the walls 2b and 72 and are mounted to these walls. The shaft 75 extends throughout the space between the walls 72 and 73 and are mounted to these walls. The shaft 76 extends throughout the space between the walls 73 and 2c and are mounted to these walls. As illustrated, the shafts 74 and 76 are at the same height, and the shaft 75 at the middle is at a higher position. Each row comprises seventeen projection rollers 81 through 97. Each roller has a single array of projections. In the illustrated embodiment, an array consists of four equally spaced projections. Four rollers are mounted on the shaft 74, and on the shaft 76, respectively. The remaining nine rollers are mounted on the shaft 75. As will be observed, the distance between the top end of the projection and the axis of the roller is so determined that a curve connecting the uppermost points of the projections of each row is bent upward. The height of the shafts of the other rows may be so varied that curves connecting the uppermost points of the projections aligned in a direction perpendicular to the rows are all upwardly bent.

Alternatively, or in addition, the distance between the top end of the projection and the axis of the roller may be so varied that the curves connecting the uppermost points of the projections aligned in a direction are all upwardly bent.

By having the shafts positioned at different heights, the curvature of the curve connecting the uppermost points of the projections can be increased.

Since each roller have only one array of projections, and the distance between the top end of the projection and the axis of the roller can differ between the adjacent rollers mounted on the common shaft, smoothness of the curve connecting the uppermost points of the projections of each row is improved.

In the illustrated embodiment, only a single pair of intermediate walls are provided. However, more than two intermediate walls may be provided so that the curves connecting the uppermost points of the projections may be varied as desired.

As an alternative to resilient projections, rigid projections such as those formed of hard plastic material may be used. Rigid projections are suitable for massaging the swollen or indurated sole.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. A device for massaging the sole of a foot, comprising a plurality of roller assemblies substantially parallel to each other and a frame for rotatably mounting said roller assemblies by means of a plurality of substantially parallel shafts;

each of said roller assemblies including a plurality of rollers disposed in a row and projections disposed on each of said rollers so as to extend from the surface of said roller in the radial direction of each said roller;

said projections being mounted on each of said rollers so that a line tangent to the top ends of said projections of each roller assembly in the axial direction of said shaft forms a substantially smooth convex line; and said roller assemblies being mounted in said frame in such a manner that each line tangent to each top end of said projections of said roller assemblies adjacent to each other in the direction perpendicular to said shafts becomes a substantially smooth convex line.

2. A device as defined in claim 1, wherein the length of said projections of each roller assembly is relatively large at the middle of the assembly and is decreased toward both ends of the assembly, and the length of the corresponding projections of said roller assemblies adjacent to each other is relatively large at the middle of said assemblies and is decreased toward both outside edges of said assemblies.

3. A device as defined in claim 1, wherein the length of said projections of each roller assembly is relatively large at the middle of the assembly and is decreased toward both ends of the assembly, and the height at which said shafts are positioned in the frame is elevated at the middle of said plurality of shafts and is decreased toward both outside edges of said plurality of shafts.

4. A device as defined in claim 1, wherein said rollers of each roller assembly are rotatably mounted on said shafts, and said shafts are bent upwardly.

5. A device as defined in claim 4, wherein the curvature of said shafts is relatively large at the middle of said plurality of shafts and is decreased toward both outside edges of said plurality of shafts.

6. A device as defined in claim 1, wherein said frame comprises a pair of side walls parallel to each other and at least a pair of intermediate walls substantially parallel to said side walls, each of said roller assemblies is provided with a plurality of shafts extending through the respective spaces defined between the adjacent ones of said walls, and the height of mounting the intermediate shafts of each roller assembly is elevated at the middle of said assembly and is decreased toward both ends of the respective assembly.

7. A device as defined in claim 6, wherein the height of said intermediate shafts among said roller assemblies adjacent to each other is elevated at the middle of said walls and is decreased toward both ends of said walls.

* * * * *